US007926283B2

(12) United States Patent
Byrne et al.

(10) Patent No.: US 7,926,283 B2
(45) Date of Patent: Apr. 19, 2011

(54) GAS TURBINE COMBUSTION SYSTEM COOLING ARRANGEMENT

(75) Inventors: William Byrne, Simpsonville, SC (US); Mert Berkman, Greenville, SC (US); David Cihlar, Greenville, SC (US)

(73) Assignee: General Electric Company, Schenectady, NY (US)

( * ) Notice: Subject to any disclaimer, the term of this patent is extended or adjusted under 35 U.S.C. 154(b) by 37 days.

(21) Appl. No.: 12/393,053

(22) Filed: Feb. 26, 2009

(65) Prior Publication Data

US 2010/0215476 A1 Aug. 26, 2010

(51) Int. Cl.
*F02G 3/00* (2006.01)

(52) U.S. Cl. ..... 60/752; 60/800

(58) Field of Classification Search ..... 60/752, 60/754, 755, 756, 757, 800
See application file for complete search history.

(56) References Cited

U.S. PATENT DOCUMENTS

| | | | | |
|---|---|---|---|---|
| 6,334,310 | B1 | 1/2002 | Sutcu et al. | |
| 6,968,693 | B2 | 11/2005 | Colibaba-Evulet et al. | |
| 7,010,921 | B2 | 3/2006 | Intile et al. | |
| 7,082,766 | B1 | 8/2006 | Widener et al. | |
| 7,082,770 | B2 | 8/2006 | Martling | |
| 7,096,668 | B2 * | 8/2006 | Martling et al. | 60/757 |
| 7,260,935 | B2 | 8/2007 | Colibaba-Evulet et al. | |
| 2005/0268615 | A1 | 12/2005 | Bunker et al. | |
| 2006/0010874 | A1 | 1/2006 | Intile et al. | |
| 2007/0169484 | A1 * | 7/2007 | Schumacher et al. | 60/754 |
| 2008/0016876 | A1 | 1/2008 | Colibaba-Evulet et al. | |
| 2008/0034759 | A1 | 2/2008 | Bulman et al. | |
| 2008/0155987 | A1 | 7/2008 | Amond et al. | |

* cited by examiner

*Primary Examiner* — Louis Casaregola
(74) *Attorney, Agent, or Firm* — Pearne & Gordon LLP

(57) ABSTRACT

Cooling is provided for a gas turbine combustion system that includes a first member, such as a liner, having exterior and interior surfaces that define a wall therebetween and a central area. A second member, such as a cap, is located adjacent that interior surface. A source of cooling gas is in fluid communication with the exterior surface of the first member. An open space, in which is located a hula seal, is located between the interior surface of the first member and the second member. At least one opening in the wall of the first member provides a passageway for the cooling gas from the exterior surface of the first member to the open space. The passageway has a directional axis along which the cooling gas flows and is discharged into the open space. The directional axis is substantially oriented in a direction other than a direction towards the central area of the first member.

13 Claims, 3 Drawing Sheets

GAS TURBINE COMBUSTION SYSTEM COOLING ARRANGEMENT

BACKGROUND OF THE INVENTION

The present invention relates generally to the cooling of parts and components of gas turbine combustion systems and in particular to the cooling of hula seals and caps employed in such systems.

The combustion of air/fuel mixtures as typically occurs in gas turbine combustion systems generates significant quantities of heat in the form of hot combustion gases at temperatures that can be detrimental to, if not destructive of, the parts and components that make up such systems. In some instances, the need for cooling arises not in the region where the combustion itself takes place but in regions where the hot combustion gases are ingested. To alleviate the problems that hot combustion gases present, cooling arrangements typically are provided as important features of gas turbine combustion systems.

Most often, the cooling arrangements of gas turbine combustion systems make use of the compressed or high pressure air that is otherwise available in the gas turbine combustion systems. Thus, the high pressure air can be used both for cooling purposes as well as for mixing with the fuel for combustion purposes.

Often times the cooling arrangements are distinctively designed so as to deal with particular cooling needs or desiderata. In any case, it can be particularly useful to provide a cooling arrangement that results in important reductions in the temperatures of the parts and components of the combustion systems while not employing significant quantities of cooling air for the purpose.

BRIEF SUMMARY OF THE INVENTION

The following presents a simplified summary of the invention in order to provide a basic understanding of some examples of aspects of the invention. This summary is not an extensive overview of the invention. Moreover, this summary is not intended to identify critical elements of the invention nor delineate the scope of the invention. The sole purpose of the summary is to present certain concepts of the invention in simplified form as a prelude to the more detailed description that is presented later.

In accordance with one aspect, the present invention relates to a gas turbine combustion system that includes a first member that has an exterior surface and an interior surface that define a wall of the first member therebetween. The wall of the first member is configured so that the first member substantially includes an enclosure having a central area. A source of a cooling gas is in fluid communication with at least the exterior surface of the first member. A second member of the system is located at least in part adjacent the interior surface of the first member and is at least partially enclosed by the wall of the first member. The arrangement of the first member with respect to the second member provides for a substantially open space that is located at least partially between the interior surface of the first member and the second member. The wall of the first member includes at least one opening that provides at least one passageway for the cooling gas to flow from the exterior surface of the first member through the wall of the first member to the substantially open space. The at least one passageway is configured so as to have a directional axis along which the cooling gas flows through the at least one passageway and is discharged into the substantially open space. In one aspect, the directional axis is substantially oriented in a direction other than directly towards the central area of the first member.

In examples of the foregoing aspect, a hula seal can be located at least partially in the open space between the first member and the second member and the second member can include a cap in which the fuel nozzles of the gas turbine combustion system are at least partially contained. Thus, in such instances, the present invention can provide for the effective cooling of the hula seal and cap.

BRIEF DESCRIPTION OF THE DRAWINGS

The foregoing and other aspects of the present invention will be apparent to those skilled in the art to which the invention relates from the detailed descriptions of examples of embodiments of the invention that follow with reference to the accompanying drawings, wherein the same reference numerals are used in the several figures to refer to the same parts or elements, and in which.

DESCRIPTION OF EXAMPLE EMBODIMENTS

Example embodiments that incorporate one or more aspects of the present invention are described below with reference to the drawings. These illustrated examples are not intended to be a limitation on the present invention. For example, one or more aspects of the present invention can be utilized in other embodiments and even other types of devices. Moreover, certain terminology is used herein for convenience only and is not to be taken as a limitation on the present invention.

Figure 1:
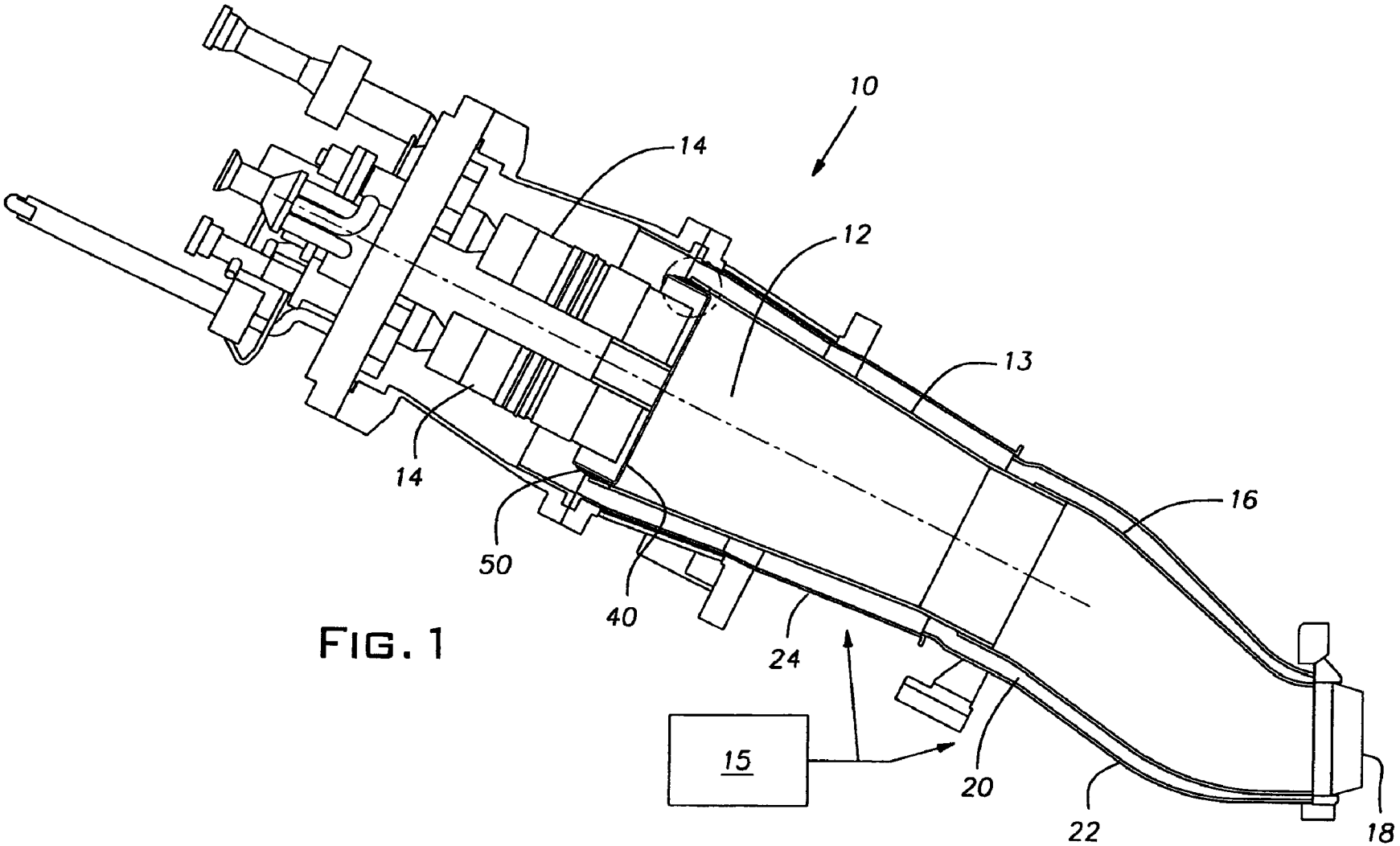
FIG. 1 is a schematic representation of a gas turbine combustion system that includes an example of the present invention.

Referring first to FIG. 1, a gas turbine combustion system 10 of a general type familiar to those of ordinary skill in the art is shown. The gas turbine combustion system 10 generates the hot combustion gases needed to drive a turbine by combusting a mixture of air and fuel within a confined space and discharging the resulting hot gases through an array of turbine blades. In such an operation, for example, high pressure gases, typically air from a compressor 15, are mixed with a fuel within the fuel nozzles 14. The air/fuel mixture is discharged from the fuel nozzles 14 into a combustion chamber 12 that is defined by a liner 13, which includes a first member of the gas turbine combustion system, where the mixture is combusted and the combustion gases that result flow at a high velocity into turbine section 18 through transition piece 16.

At least a portion of the high pressure gases also serve to cool certain parts and components of the system prior to being mixed with the fuel in the fuel nozzles 14. In the embodiment of FIG. 1, the gases, for example, exit the compressor 15, enter the annular space 20 through openings (not shown) provided in first sleeve 22 and second sleeve 24 and flow upwardly of the annular space so as to cool the outside of the transition piece 16 and the liner (hereafter the first member) 13. Thereafter, the high pressure gases flow into the fuel nozzles 14 where they mix with the fuel in the nozzles. The high pressure gases, in addition, cool those components of the combustion system that are located at the top of the first member 13 and the bottom of the fuel nozzles 14. These components include a cap 40 that includes a second member of the gas turbine combustion system and a hula seal 50. A detailed and enlarged perspective view of the cap 40 and the hula seal 50, along with the top or end of the first member 13, in the area that is circumscribed by the dashed line in FIG. 1 is shown in FIG. 2 and an enlarged elevational view in cross-section of that same area is shown in FIG. 3.

Figure 2:
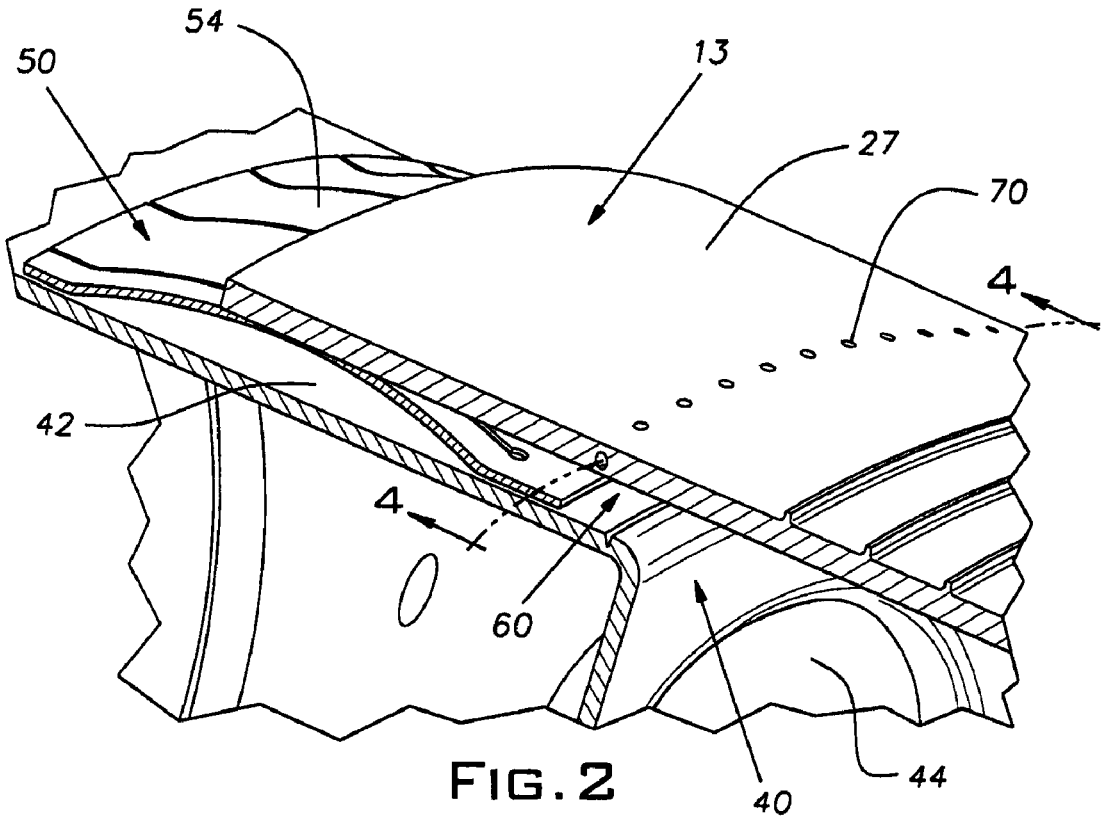
FIG. 2 is an enlarged and detailed perspective view, partly in section, of the portion of the system encircled by dashed lines in FIG. 1 and showing an example embodiment of the invention.
Figure 3:
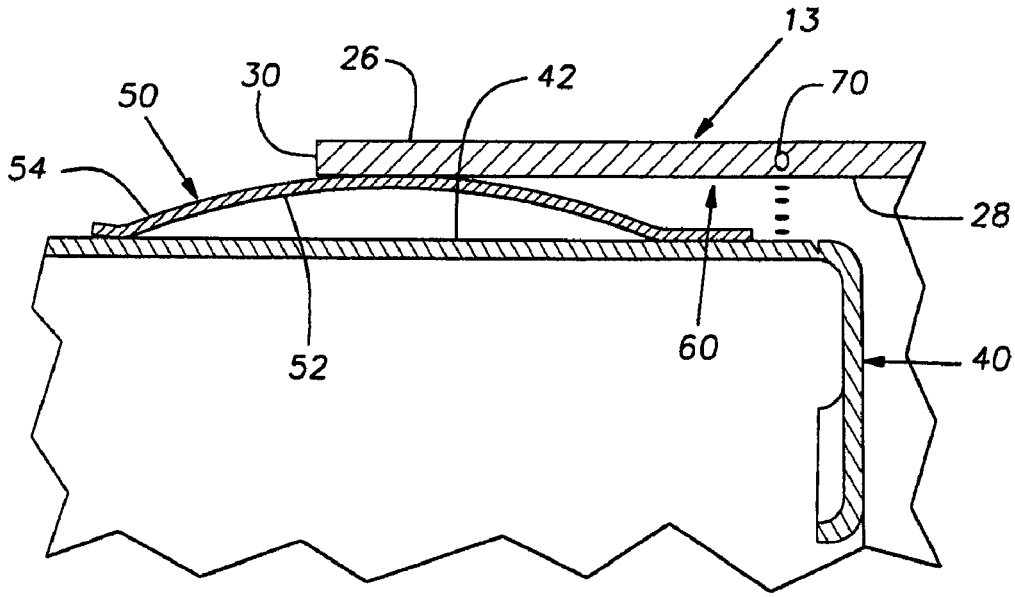
FIG. 3 is an enlarged and detailed elevation view, in section, of the potion encircled by dashed lines in FIG. 1.

Referring to FIGS. 2 and 3, in that example embodiment, the first member 13 is shown to have an exterior surface 26 and an interior surface 28 that define a wall 30 of the first member therebetween. The wall 30 of the first member 13 is configured so that the first member substantially includes an enclosure that has a central area. In this regard, although it need not be the case, the liner or first member 13, as illustrated in the embodiment of FIGS. 2 and 3, has at least a section, such as indicated at 27, that is substantially cylindrical. In that case, the wall 30 of the substantially cylindrical section 27 can be substantially annular in its configuration as illustrated in FIGS. 2 and 3. Also in that case, the central area of the substantially cylindrical section 27 of the first member 13 would include the vicinity adjacent the central axis of the cylindrical section. In an alternative embodiment where the first member 13 in its entirety or in a section has an elliptical cross-section, for example, the central area would include the vicinity adjacent the intersection of the major and minor axes of the elliptical cross-section. In another alternative embodiment where the first member 13 in its entirety or in a section has a polygonal cross-section such as an octagonal cross-section for example, the vicinity adjacent the center of the octagonal cross-section would include the central area. It will be understood by those having ordinary skill in the art that the first member 13 can include an enclosure that has a variety of shapes and configurations, either entirely or in one or more sections, and the central areas of such enclosures would lay in the vicinity of the respective centers of those enclosures.

The cap (herein referred to as the second member) 40, in the embodiment of FIGS. 2 and 3, is shown as being substantially cylindrical and as having an exterior surface 42. In that embodiment, at least a portion of the second member 40 is positioned internally of and substantially coaxially with the first member 13. An access opening 44 is shown as being present in the second member 40 through which one of the fuel nozzles can extend such that the fuel/air mixture can be discharged into the combustion chamber 12. The bottom or exit end of the fuel nozzles 14 can be supported within the second member 40 in a manner familiar to those having ordinary skill in the art so that the second 40 contains at least a portion of one or more of the fuel nozzles 14 of the gas turbine combustion system. In such an arrangement, and as shown in the embodiment of FIGS. 2 and 3, the second member 40 is located at least in part adjacent the interior surface 28 of, or at least in part within, the substantially cylindrical section 27 of the first member 13.

The liner or first member 13 and the second member 40 are arranged with respect to one another so as to establish a cavity or substantially open space 60 that is located at least partially between the interior surface 28 of the substantially cylindrical section 27 of the first member 13 and the second member 40. Thus, the interior surface 28 of the wall 30 of the substantially cylindrical section 27 of the first member 13 is spaced away from the exterior surface 42 of the second member 40 so as to define the substantially open space 60 therebetween. In the illustrated embodiment, the wall 30 is substantially annular.

As can be seen from FIGS. 2 and 3, in the embodiment illustrated in those figures, at least a portion of a hula seal 50 is located in the substantially open space 60 between the interior surface 28 of the wall 30 of the substantially cylindrical section of the first member 13 and the exterior surface 42 of the second member 40. In the embodiment of FIGS. 2 and 3, one side 52 of the hula seal is attached, as by welding for example, to the second member 40 and the liner or first member 13 rests on the opposite side 54 of the hula seal 50.

With the gas turbine combustion system described, it can occur that hot combustion gases from the combustion chamber 12 are ingested into the region where the second member 40 and the hula seal 50 are located, including the substantially open space 60, resulting in the potential establishment of deleterious high temperatures at the cap and the hula seal. The present invention addresses this problem as will now be described.

As indicated above, the gas turbine combustion system includes a compressor 15 that serves as a source of cooling gas that flows through the annular space 20. This source of cooling gas is in fluid communication with at least the exterior surface 26 of the first member 13 and, in particular, with the of the substantially cylindrical section 27 of the first member 13 at the wall 30, which can be substantially annular, whereby the second member 40 and the hula seal 50 are cooled.

Figure 4:
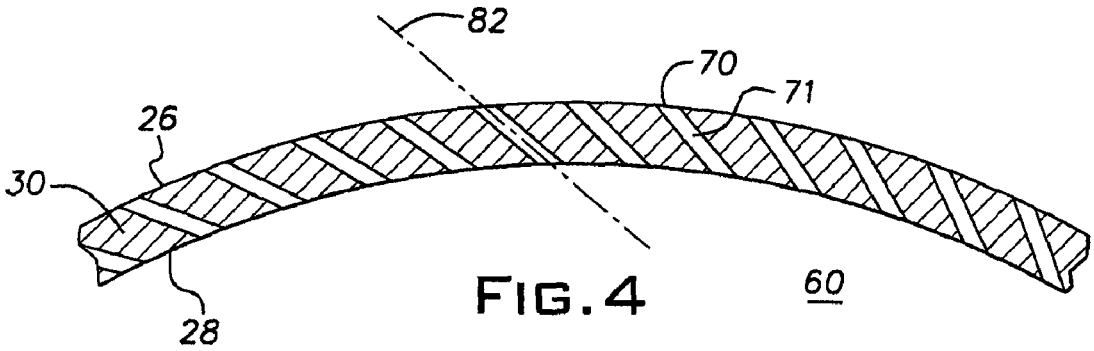
FIG. 4 is a sectional view through line 4-4 of FIG. 2.

Specifically, at least one opening 70 is provided in the wall 30 of the substantially cylindrical section 27 of the first member 13. The at least one opening 70 provides at least one passageway 71, as shown in FIG. 4, for the cooling gas to flow from the exterior surface 26 of the substantially cylindrical section 27 of the first member 13, through the wall 30 of the substantially cylindrical section of the first member, to the substantially open space 60, which in one embodiment is located between the interior surface 28 of the wall 30 of the substantially cylindrical section 27 of the first member 13 and the exterior surface 42 of the second member 40. As shown in FIG. 4, the at least one passageway 71 has a directional axis 82 along which the cooling gas will flow through the at least one passageway and be discharged into the substantially open space 60. As also can be seen from FIG. 4, the directional axis 82 is substantially aligned with a circumference of the substantially cylindrical section 27 of the first member 13. That is, a plane exists that substantially contains both a circumference of the substantially cylindrical section 27 and the directional axis 82. As a consequence, the cooling gas will be inclined to flow at least partly circumferentially of the interior surface 28 of the substantially cylindrical section 27.

In the embodiment shown in the drawings, the at least one passageway 71 through the wall 30 of the substantially cylindrical section 27 of the first member 13 includes a plurality of such passageways equally spaced from one another on a circumference of the substantially cylindrical section of the first member so that the directional axes of the passageways are aligned with that circumference. Alternatively, for example, the locations of the passageways can be staggered in such a fashion that the passageways are aligned with different circumferences of the substantially cylindrical section of the first member 13.

Figure 5:
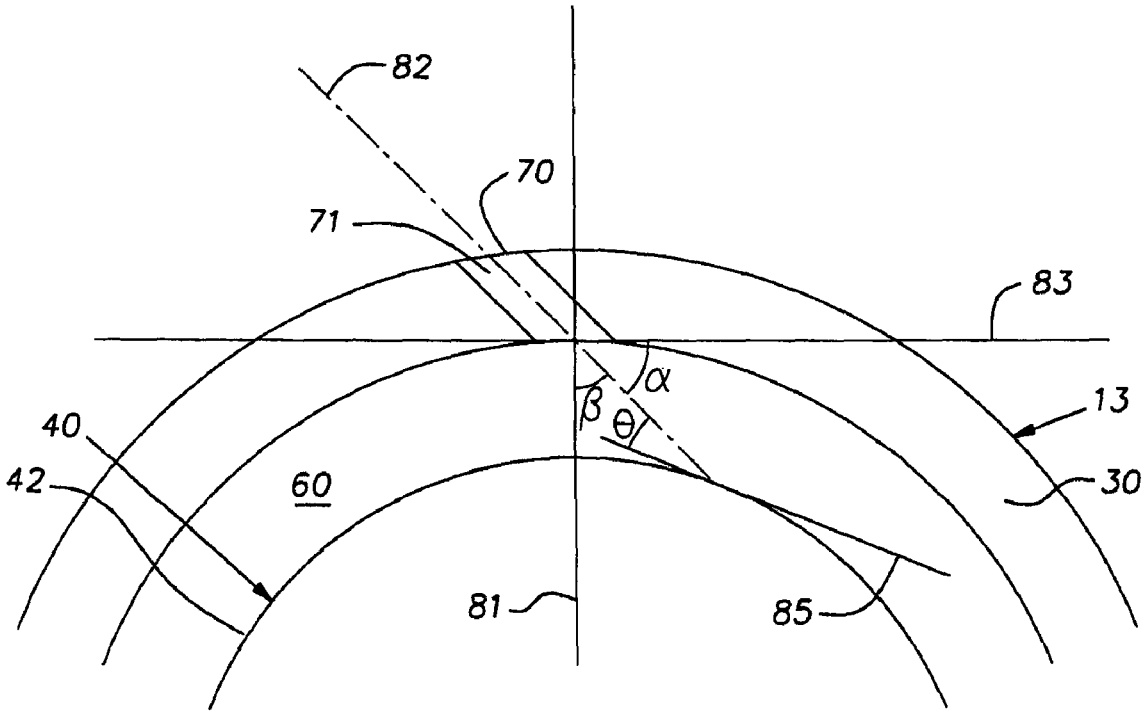
FIG. 5 is a schematic representation that illustrates certain geometric relationships that relate to examples of embodiments of the invention.

Reference is now had to FIG. 5 which is a schematic representation of the arrangement of the at least one passageway 71, the substantially cylindrical section 27 of the first member 13 and the second member 40 for the purpose of discussing certain geometric relationships that can exist with respect to several aspects of the invention.

In one aspect, as described above, the at least one opening 70 in the wall 30 of the first member 13 provides at least one passageway 71 for the cooling gas to flow from the exterior surface 26 of the first member through the wall of the first member to the substantially open space 60. The at least one passageway 71 is configured so as to have a directional axis 82 along which the cooling gas flows through the at least one passageway and is discharged into the substantially open space 60. The directional axis 82, as can be seen in FIG. 5, is substantially oriented in a direction other than directly towards the central area of the first member 13 which, in the particular case where the first member is cylindrical, would be the area adjacent the central axis of the cylinder.

In another aspect, the at least one passageway 71 is configured so as to direct the cooling gas into the substantially open space 60 along a directional axis 82 which extends along a line other than a radial line of the substantially cylindrical section 27 of the first member 13. In a particular instance of this aspect, as illustrated in FIG. 5, the directional axis 82, which extends along a line other than a radial line, and the radial line 81 of the substantially cylindrical section 27 of the first member 13 that intersects the directional axis 82 at substantially the point where the cooling gas is discharged into the substantially open space 60 subtend an angle $\beta$ that is other than zero or ninety degrees. The value of the angle can vary depending on at least the spatial relationships between the various components and their particular configurations. In one embodiment, the subtended angle is forty-five degrees.

In a further aspect, the at least one passageway 71 is configured to have a directional axis which, in at least one plane that contains the directional axis, is at an angle of other than zero or ninety degrees to the wall of the first member regardless of whether the wall is flat such as, for example, where the cross-section of the first member 13 is polygonal or whether the wall is curvilinear such as, for example, where the cross-section of the first member is circular or elliptical. In the particular case illustrated in FIG. 5, the directional axis 82, in at least one plane that contains the directional axis, such as the plane of FIG. 5, is at an angle $\alpha$ of other than zero or ninety degrees, such as forty-five degrees for example, to the wall 30 of the first member 13, as represented by the first member tangent line 83 through the point of intersection between the directional axis 82 and the radial line 81 of the first member 13. The value of the angle $\alpha$ can vary for at least the same reasons that the angle $\beta$ can vary.

Although not specifically illustrated in the drawings, the at least one passageway 71 can be configured so that the directional axis of the at least one passageway is directed other than along a radial line of the substantially cylindrical section of the first member and other than in substantial alignment with a circumference of the substantially cylindrical section of the first member. In that case, the motion of the cooling gas, even though the directional axis would not be aligned with a circumference of the substantially cylindrical section, would have both a circumferential component and a component that would cause the cooling gas to move axially of the substantially cylindrical section. In such an instance, the configuration of the passageway would be such that the directional axis of the passageway would be at an angle of other than ninety degrees to the wall of the substantially cylindrical section in each of at least two planes containing the directional axis.

In a further aspect, the at least one passageway 71 in the wall 30 of the substantially cylindrical section 27 of the first member 13 can have a substantially cylindrical configuration as shown in the figures, although passageways having other configurations can be employed. For example, passageways having the configuration of an ellipse in cross-section can be employed. In any event, the longitudinal axis of the passageway, which coincides with the directional axis 82 of the passageway for the embodiment shown in the figures, can be arranged at an angle of other than ninety degrees to the substantially annular wall, as represented by the first member tangent line 83 of FIG. 5, in alignment with a circumference of the substantially cylindrical section of the first member.

In particular cases of each of the foregoing aspects, as representatively shown in FIG. 5, the at least one passageway can be further configured so that the directional axis 82 of the at least one passageway 71 is directed toward the second member 40 in a manner that the cooling gas discharged to the substantially open space 60 along the directional axis of the at least one passageway impinges on the exterior surface 42 of the second member 40 at an angle of other than ninety degrees to the exterior surface 42. Thus, as shown in the example embodiment of FIG. 5, directional axis 82 is arranged so that cooling gas impinging on the exterior surface 42, as represented by the second member tangent line 85 in FIG. 5, does so at an angle $\theta$ that is other than ninety degrees to the exterior surface 42 in at least one plane, such as the plane of FIG. 5, containing the directional axis 82. Stated otherwise, the at least one passageway 71 is configured so that the directional axis 82 of the at least one passageway is directed toward the exterior surface 42 of the second member 40 such that the cooling gas discharged into the substantially open space 60 along the directional axis 82 of the at least one passageway impinges on the exterior surface of the second member at an angle other than an angle that would cause the cooling gas to be substantially reflected back along the directional axis.

It will be understood from the foregoing description that, in addition to providing for a gas turbine combustion system 10 within which components (e.g., 13, 16, 40, 50) are cooled, the present invention among its embodiments provides a associated method of cooling one or more components of a gas turbine combustion system. The method includes: passing the cooling gas though at least one passageway 70 in the wall 30 of a first member 13 having a central area and into an open space 60 between the first member 13 and a second member 40 located at least in part within the first member 13; and discharging the cooling gas into the open space 60 in a directional orientation that is substantially aligned with a direction 82 other than directly towards the central area of the first member.

In a particular embodiment of the method, the first member 13 includes at least a substantially cylindrical section 27 and the second member 40 is located at least in part within the substantially cylindrical section 27 of the first member 13. The open space 60 is located at least in part between the substantially cylindrical section 27 of the first member 13 and the second member 40 and the at least one passageway 71 is located in the substantially cylindrical section 27 of the first member 13. The cooling gas is passed through the at least one passageway 71 in the wall 30 of the substantially cylindrical section 27 of the first member 13 and into the open space between the substantially cylindrical section 27 of the first member 13 and the second member 40 and is discharged into the open space in a directional orientation 82 that is substantially aligned with a circumference of the substantially cylindrical section 27 of the first member 13. The cooling gas can be passed through a plurality of passageways 71 in the wall 30 of the substantially cylindrical section 27 of the first member 13 and directed into the open space 60 in a directional orientation that is substantially aligned with a circumference of the substantially cylindrical section 27 of the first member 13.

In related aspects of the method, at least a portion of a hula seal 50 is located in the open space 60 as described above. In other related aspects of the method, the second member 40 can include a cap in which is contained at least a portion of one or more fuel nozzles 14 of the gas turbine combustion system 10.

In further related aspects of the method, the second member 40 can have an exterior surface 42 and the cooling gas can be directed into the open space 60 so as to impinge on the exterior surface 42 of the second member 40 at an angle θ other than an angle that would cause the cooling gas impinging on the exterior surface 42 of the second member 40 to be substantially reflected back in the direction in which the cooling gas has been directed to the exterior surface 42.

Providing the at least one passageway 71 in a manner such that the cooling gas is discharged into the open space 60 in a directional orientation 82 that is substantially aligned with a direction other than directly towards the central area of the first member 13 results in a cooling gas force vector that tends to create a circumferential flow of cooling air within the substantially open space 60 or a flow of air that tends to pass along the interior perimeter of the first member 13. Such a circumferential or perimetrical flow of air can be of benefit in several respects. The circumferential or perimetrical flow can control the ingestion of the hot combustion gases into the substantially open space 60 and/or purge any hot combustion gases that might enter the substantially open space 60 (i.e., cavity), thereby controlling the temperature impact of the hot combustion gases on the cap and hula seal. In addition, the circumferential or perimetrical flow of cooling gas can extend the time that it takes the cooling air to pass through the substantially open space 60. As a result, the frequency at which the hula seal 50 and cap 40 must be repaired or replaced can be benefitted. It also can be the case that a lesser quantity of cooling gas is required to carry out the cooling function at the hula seal 50 and the cap 40 according to an embodiment of the invention. And to the extent less cooling gas is required, gas turbine efficiency can be increased and emissions reduced. Alternatively, at least some of the air not required for cooling the hula seal 50 and cap 40 can be redirected to other components of the system that may in some instances be at a higher risk of failure from high temperature effects.

While the invention has been described above and illustrated with reference to certain embodiments of the invention, it is to be understood that the invention is not so limited. Modifications and alterations will occur to others upon a reading and understanding of the specification, including the drawings. For example, the various angles at which the at least one passageway 71 is arranged can be enhanced in different instances as will be understood by those having ordinary skill in the art. In any event, the invention covers and includes any and all modifications and variations to the embodiments that have been described and that are encompassed by the following claims.

What is claimed is:

1. A gas turbine combustion system including:

a first member having an exterior surface and an interior surface that define a wall of the first member therebetween, the wall of the first member being configured so that the first member substantially includes an enclosure having a central area;

a second member located at least in part adjacent the interior surface of the first member and being at least partially enclosed by the wall of the first member;

a substantially open space located at least partially between the interior surface of the first member and the second member;

a source of a cooling gas in fluid communication with at least the exterior surface of the first member; and at least one opening in the wall of the first member providing at least one passageway for the cooling gas to flow from the exterior surface of the first member through the wall of the first member to the substantially open space, the at least one passageway being configured so as to have a directional axis along which the cooling gas flows through the at least one passageway and is discharged into the substantially open space, the directional axis being substantially oriented in a direction other than directly towards the central area of the first member;

wherein at least a portion of a hula seal is located in the substantially open space and the second member includes a cap in which is contained at least a portion of one or more fuel nozzles of the gas turbine combustion system.

2. A gas turbine combustion system including:

a first member having an exterior surface and an interior surface that define a wall of the first member therebetween, the wall of the first member being configured so that the first member substantially includes an enclosure having a central area a second member located at least in part adjacent the interior surface of the first member and being at least partially enclosed by the wall of the first member;

a substantially open space located at least partially between the interior surface of the first member and the second member;

a source of a cooling gas in fluid communication with at least the exterior surface of the first member; and at least one opening in the wall of the first member providing at least one passageway for the cooling gas to flow from the exterior surface of the first member through the wall of the first member to the substantially open space, the at least one passageway being configured so as to have a directional axis along which the cooling as flows through the at least one passageway and is discharged into the substantially open space, the directional axis being substantially oriented in a direction other than directly towards the central area of the first member;

wherein:

the first member includes at least a section that is substantially cylindrical;

the second member is located at least in part adjacent the interior surface of the substantially cylindrical section of the first member;

the substantially open space is located at least partially between the interior surface of the substantially cylindrical section of the first member and the second member;

the source of a cooling gas is in fluid communication with at least the exterior surface of the substantially cylindrical section of the first member; and the at least one opening is located in the wall of the substantially cylindrical section of the first member and provides at least one passageway for the cooling gas to flow from the exterior surface of the substantially cylindrical section through the wall of the substantially cylindrical section to the substantially open space, the directional axis of the at least one passageway being substantially aligned with a circumference of the substantially cylindrical section of the first member.

3. The gas turbine combustion system of claim 2 wherein at least a portion of a hula seal is located in the substantially open space.

4. The gas turbine combustion system of claim 3 wherein one side of the hula seal is attached to the second member and the first member rests on the opposite side of the hula seal.

5. The gas turbine combustion system of claim 3 wherein the second member includes a cap in which is contained at least a portion of one or more fuel nozzles of the gas turbine combustion system.

6. The gas turbine combustion system of claim 2 wherein the second member has an exterior surface and the at least one passageway is configured so that the directional axis of the at least one passageway is directed toward the exterior surface of the second member such that the cooling gas discharged into the substantially open space along the directional axis of the at least one passageway impinges on the exterior surface of the second member at an angle other than an angle that would cause the cooling gas to be substantially reflected back along the directional axis.

7. The gas turbine combustion system of claim 3 wherein the at least one passageway through the wall of the substantially cylindrical section of the first member includes a plurality of such passageways substantially equally spaced from one another on a circumference of the substantially cylindrical section of the first member.

8. The gas turbine combustion system of claim 6 wherein the second member is substantially cylindrical and the substantially cylindrical section of the first member encircles at least a portion of the second member.

9. A gas turbine combustion system including:

a first member having an exterior surface and an interior surface that define a wall of the first member therebetween, the wall of the first member being configured so that the first member substantially includes an enclosure having a central area;

a second member located at least in part adjacent the interior surface of the first member and being at least partially enclosed by the wall of the first member;

a substantially open space located at least partially between the interior surface of the first member and the second member;

a source of a cooling gas in fluid communication with at least the exterior surface of the first member; and at least one opening in the wall of the first member providing at least one passageway for the cooling gas to flow from the exterior surface of the first member through the wall of the first member to the substantially open space, the at least one passageway being configured so as to have a directional axis along which the cooling gas flows through the at least one passageway and is discharged into the substantially open space, the directional axis being substantially oriented in a direction other than directly towards the central area of the first member wherein the directional axis of the at least one passageway is at an angle of other than ninety degrees to the wall of the first member in at least one plane that contains the directional axis, at least a portion of a hula seal is located in the substantially open space, and the second member includes a cap in which is contained at least a portion of one or more fuel nozzles of the gas turbine combustion system.

10. A gas turbine combustion system including:

a first member having an exterior surface and an interior surface that define a wall of the first member therebetween, the wall of the first member being configured so that the first member substantially includes an enclosure having a central area;

a second member located at least in part adjacent the interior surface of the first member and being at least partially enclosed by the wall of the first member;

a substantially open space located at least partially between the interior surface of the first member and the second member;

a source of a cooling gas in fluid communication with at least the exterior surface of the first member; and at least one opening in the wall of the first member providing at least one passageway for the cooling gas to flow from the exterior surface of the first member through the wall of the first member to the substantially open space, the at least one passageway being configured so as to have a directional axis along which the cooling gas flows through the at least one passageway and is discharged into the substantially open space, the directional axis being substantially oriented in a direction other than directly towards the central area of the first member;

wherein:

the first member includes at least a section that is substantially cylindrical;

the second member is located at least in part adjacent the interior surface of the substantially cylindrical section of the first member;

the substantially open space is located at least partially between the interior surface of the substantially cylindrical section of the first member and the second member;

the source of a cooling gas is in fluid communication with at least the exterior of the substantially cylindrical section of the first member;

the at least one opening is located in the wall of the substantially cylindrical section of the first member and provides at least one passageway for the cooling gas to flow, from the exterior surface of the substantially cylindrical section of the first member through the wall of the substantially cylindrical section of the first member to the substantially open space, the directional axis of the at least one passageway being oriented along a line other than a radial line of the substantially cylindrical section of the first member;

at least a portion of a hula seal is located in the substantially open space; and the second member includes a cap in which is contained at least a portion of one or more fuel nozzles of the gas turbine combustion system.

11. A gas turbine combustion system including:

a first member having an exterior surface and an interior surface that define a wall of the first member therebetween, the wall of the first member being configured so that the first member substantially includes an enclosure having a central area;

a second member located at least in part adjacent the interior surface of the first member and being at least partially enclosed by the wall of the first member;

a substantially open space located at least partially between the interior surface of the first member and the second member;

a source of a cooling gas in fluid communication with at least the exterior surface of the first member; and at least one opening in the wall of the first member providing at least one passageway for the cooling gas to flow from the exterior surface of the first member through the wall of the first member to the substantially open space, the at least one passageway being configured so as to have a directional axis along which the cooling gas flows through the at least one passageway and is discharged into the substantially open space, the directional axis being substantially oriented in a direction other than directly towards the central area of the first member;

wherein:

the first member includes at least a section that is substantially cylindrical and the wall of the substantially cylindrical section of the first member defined by the exterior surface and interior surface of the first member is substantially annular;

the second member is substantially cylindrical and is located at least in part within the substantially cylindrical section of the first member, the substantially cylindrical second member having an exterior surface;

the inner surface of the substantially annular wall of the substantially cylindrical section of the first member is spaced away from the exterior surface of the substantially cylindrical second member so as to define at least a portion of a substantially open space therebetween;

the source of a cooling gas is in fluid communication with at least the exterior surface of the substantially annular wall of the substantially cylindrical section of the first member; and the least one opening is located in the substantially annular wall of the substantially cylindrical section of the first member and provides at least one passageway for the cooling gas to flow from the exterior surface of the substantially annular wall of the substantially cylindrical section of the first member through the annular wall to the substantially open space between the inner surface of the substantially annular wall of the substantially cylindrical section of the first member and the outer surface of the substantially cylindrical second member, the at least one passageway in the substantially annular wall of the substantially cylindrical section of the first member having a substantially cylindrical configuration the longitudinal axis of which is arranged at an angle of other than ninety degrees to the annular wall in alignment with a circumference of the substantially cylindrical section of the first member.

12. The gas turbine combustion system of claim 11 wherein at least a portion of a hula seal is located within the substantially open space between the inner surface of the annular wall of the substantially cylindrical section of the first member and the outer surface of the substantially cylindrical second member.

13. The gas turbine combustion system of claim 12 wherein the substantially cylindrical second member includes a cap in which is contained at least a portion of one or more fuel nozzles of the gas turbine combustion system.

* * * * *